US005439417A

United States Patent [19]

Sells

[11] Patent Number: 5,439,417

[45] Date of Patent: Aug. 8, 1995

[54] ROOF VENTILATING CAP

[75] Inventor: Gary L. Sells, Mishawaka, Ind.

[73] Assignee: Cor-A-Vent, Inc., Mishawaka, Ind.

[21] Appl. No.: 333,438

[22] Filed: Nov. 2, 1994

[51] Int. Cl.[6] ..... F24F 7/02

[52] U.S. Cl. ..... 454/365; 52/57; 52/199

[58] Field of Search ..... 52/57, 199; 454/365

[56] References Cited

U.S. PATENT DOCUMENTS 4,803,813 2/1989 Fiterman ..... 454/365 X 5,094,041 3/1992 Kasner et al. ..... 454/365 X

*Primary Examiner*—Harold Joyce

*Attorney, Agent, or Firm*—Baker & Daniels

[57] ABSTRACT

The ventilating cap for the ridge of a roof includes multiple plies of ventilating material disposed on opposite sides of an opening cut along the ridge of the roof. The ventilating cap includes a connecting ply which interconnects a pair of vent parts disposed on opposite sides of the vent opening. The connecting ply is folded along a crease line, and includes a groove which extends longitudinally along the connecting ply at the crease line to permit a consistent fold of the connecting ply.

9 Claims, 6 Drawing Sheets

ROOF VENTILATING CAP

This invention relates to a ventilating cap for the ridge of a roof and the method for its manufacture.

The ventilating cap of this invention includes a pair of vent parts extending along a vent opening cut along the ridge of the roof. The vent parts each include multiple plies of a corrugated material that define vent passages venting the vent opening to ambient atmosphere. The lower ply of each vent part directly engages the roof, and the upper ply of the vent parts bridges across the vent opening to interconnect the vent parts. The upper ply must be folded; it is often difficult to provide a uniform fold along the ridge line of the roof.

According to this present invention, a groove is cut into the corrugated layer of the upper ply of the venting material such that the groove extends longitudinally along the ridge of the roof. Roll forming equipment is used to create a longitudinally extending, arcuate section of the groove substantially midway between the edges thereof. Accordingly, the upper ply can be folded uniformly along the arcuate section, thereby maintaining a constant fold along the ridge of the roof. Prior art method of providing a fold in the upper ply is disclosed in U.S. Pat. No. 5,094,041.

These and other advantages of the present invention will become apparent from the following specification, with reference to the accompanying drawings, in which.

Figure 1:
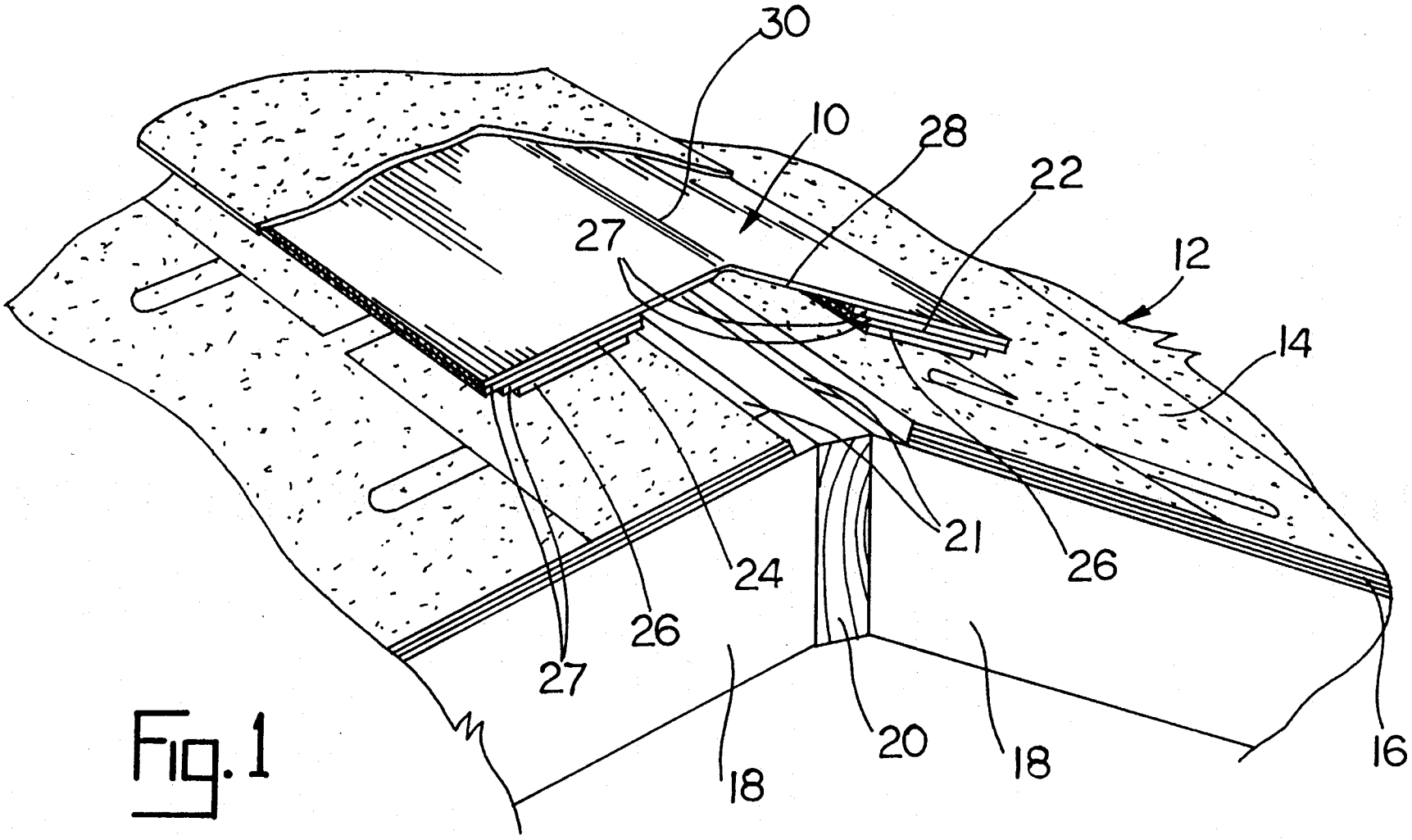
FIG. 1 is a fragmentary view in perspective of a roof illustrating the ventilating cap made pursuant to teachings of the present invention installed over a vent opening in the roof.

Referring now to the drawings a ventilating cap generally indicated by the numeral 10 is applied to a roof generally indicated by the numeral 12. The roof 12 includes shingles 14 which are applied to underlayment 16, which is supported by rafters 18. A ridge board 20 extends along the ridge of the roof and interconnects the rafters 18. The underlayment 16 is cut away as to form a vent opening generally indicated by the numeral 21 on both sides of the ridge board 20. Ventilating cap 10 includes vent parts 22 and 24 which consist of plies 26 of a corrugated material which defines passages to thereby communicate vent opening 20 with admit atmosphere. The lowermost plies 26 of the vent parts 22, 24 are applied against the shingles 14 and the upper ply 28 of both vent parts 22, 24 bridges the vent opening 21 and thus interconnects the vent parts 22, 24. The upper ply 28 must be creased as at 30 such that the upper ply 28 of the vent parts 22, 24 extends substantially parallel to the opposed upwardly tapering portions of the roof 12 on opposite sides of the ridge board 20. Intermediate plies 27 extend between lower plies 26 and upper ply 28.

Figure 6:
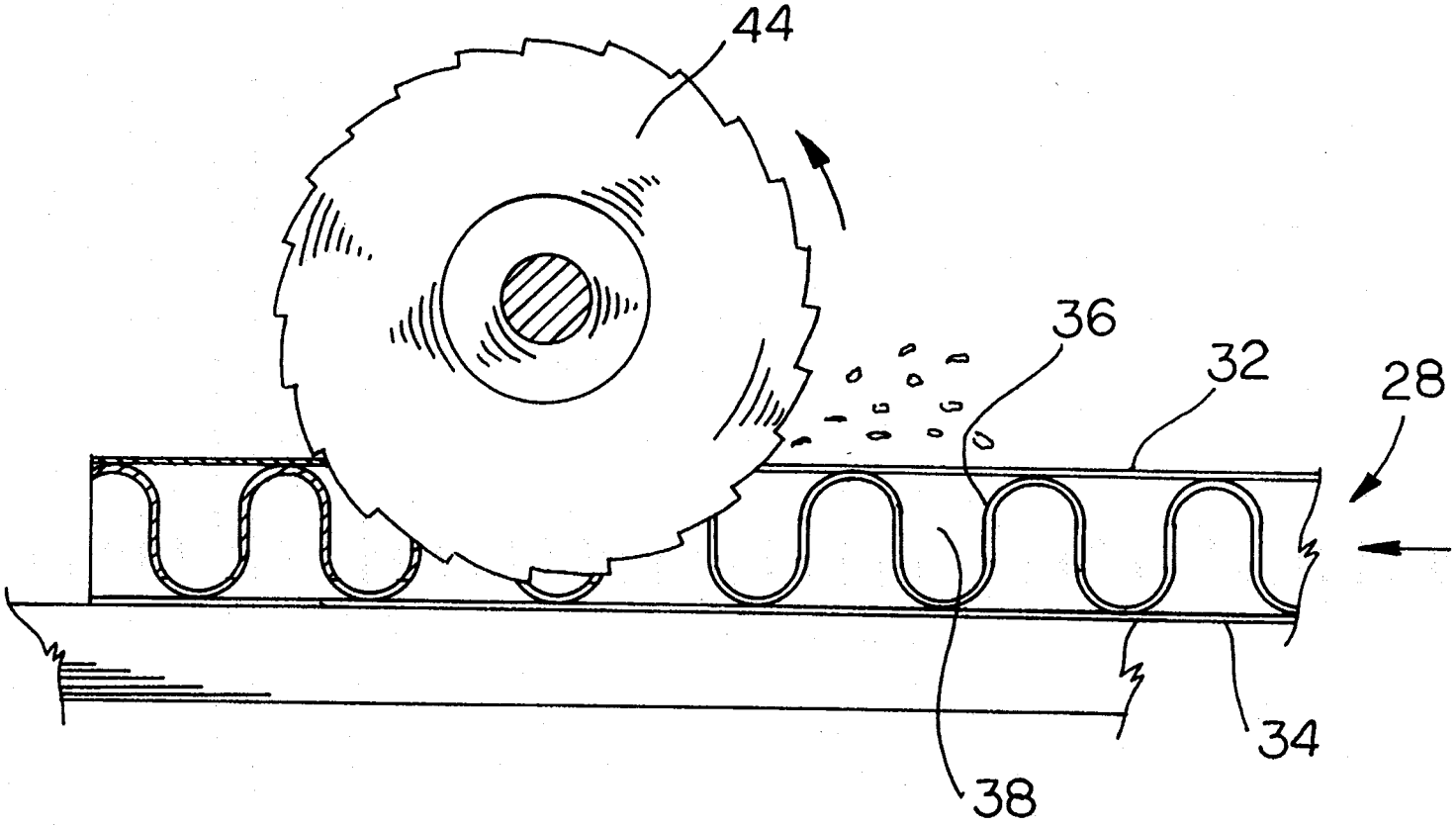
FIG. 6 is a view taken substantially along line 6—6 of FIG. 4.
Figure 7:
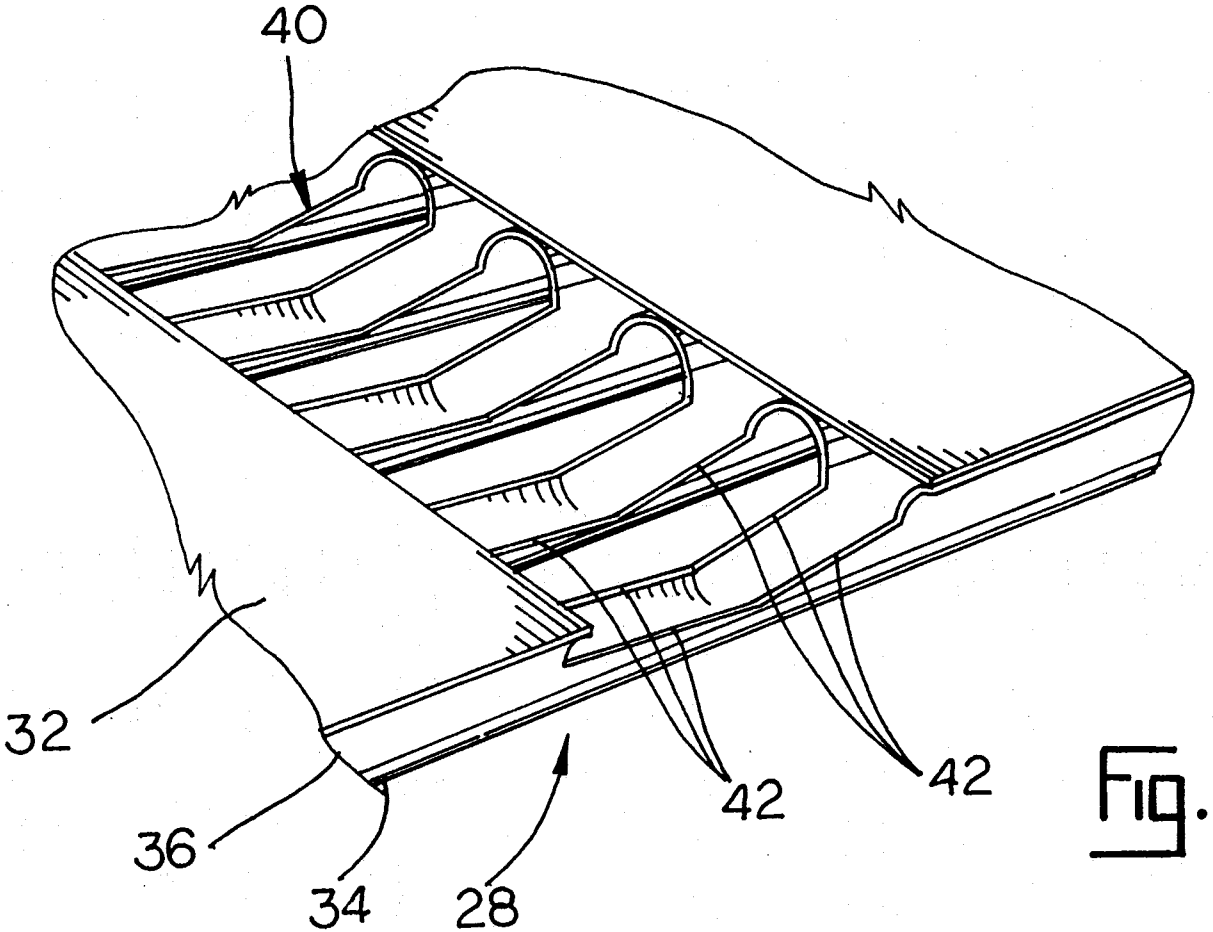
FIG. 7 is a view in perspective of the groove cut in the connective ply of the ventilating cap illustrated in FIG. 5.
Figures 8, 9:
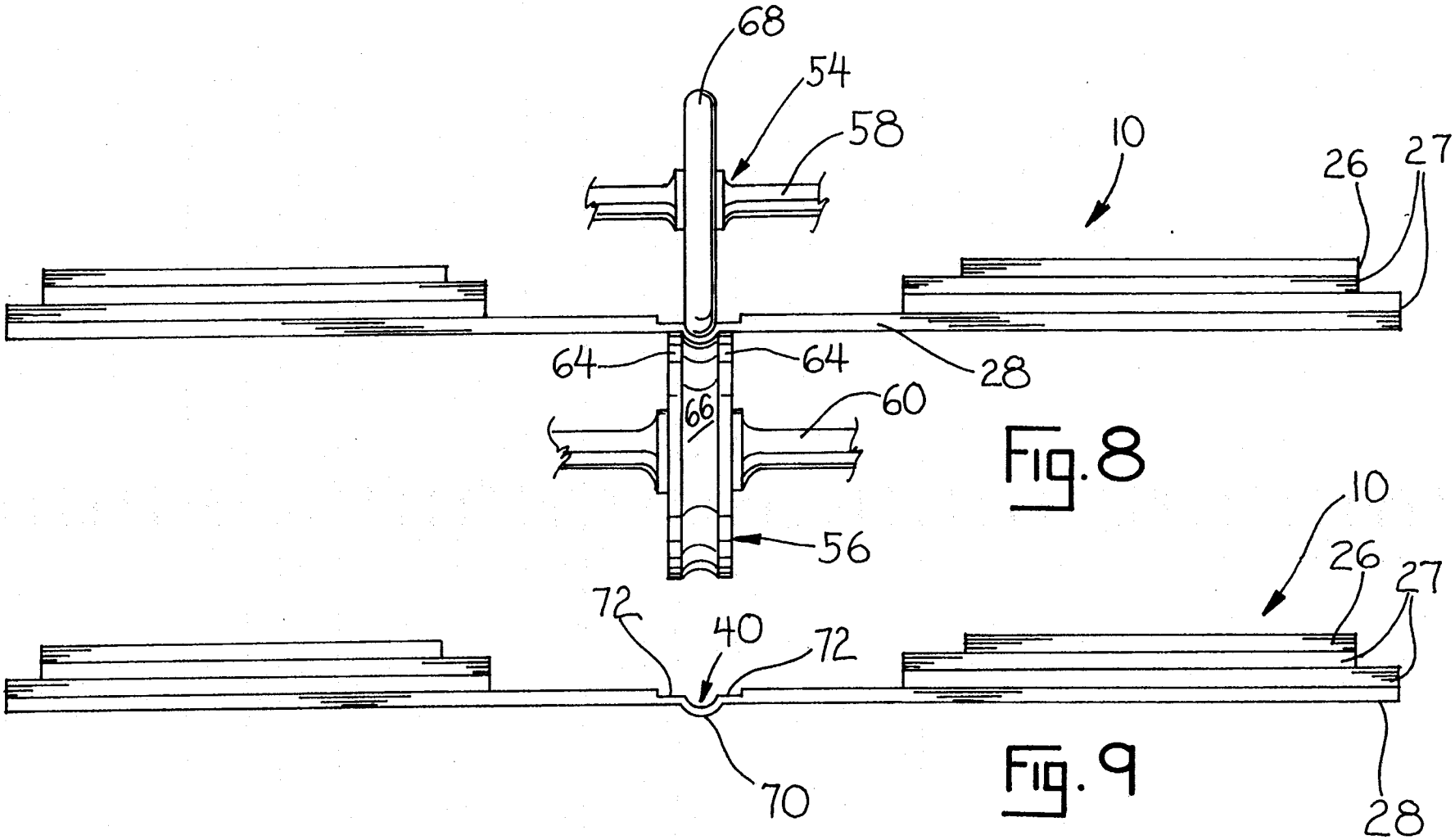
FIG. 8 is a view similar to FIG. 4 but illustrating roll forming tools which form an arcuate curve in a portion of the groove cut in the connecting ply of the ventilating cap by the apparatus illustrated in FIG. 4.
FIG. 9 is a view similar to FIG. 8 but illustrating the contour of the ventilating cap after the latter has been passed forth through the roll forming rollers of FIG. 8.

As is best illustrated in FIGS. 6 and 7, each of the plies 26–28 of the ventilating cap 10 includes upper and lower layers 32, 34 which are separated by a corrugated intermediate layer 36. The corrugated intermediate layer 36 defines the vent passages 38 which communicate the vent opening 20 with ambient atmosphere. Each ply 26–28 may be made out of plastic or paperboard dipped in plastic.

Figure 4:
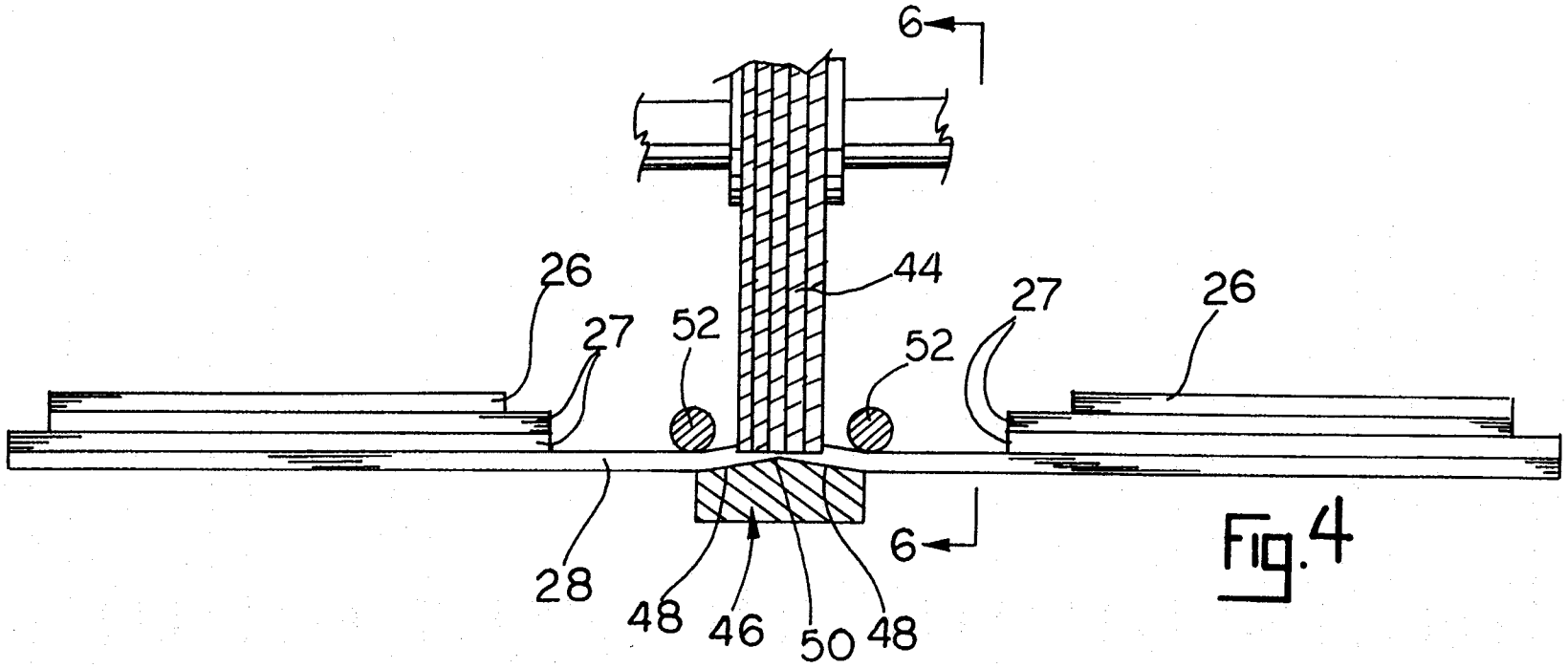
FIG. 4 is an end view of a cutting head and supporting die which illustrates the manner in which a groove is cut into the upper ply of the ventilating cap illustrated in FIG. 1 during its manufacture.
Figure 5:
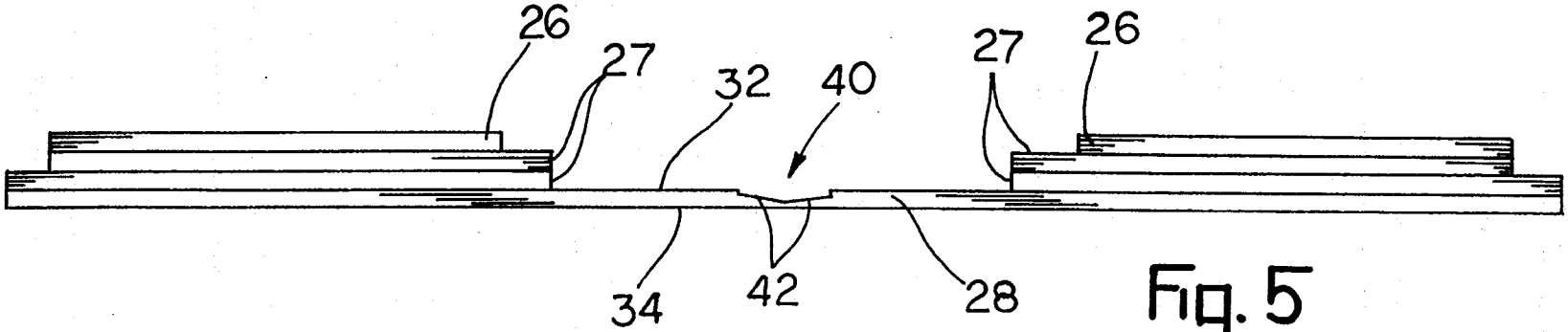
FIG. 5 is a view similar to FIG. 4 but illustrating the ventilating cap after the groove has been cut in the upper ply of the ventilating cap by the cutting device illustrated in FIG. 4.

It is important that the crease 30 be formed consistently along the length of the ventilating cap 10. It is difficult to fold corrugated material, because the corrugated intermediate layer 36 of the connecting ply 28 prevents folding in a straight, consistent, crease line. Accordingly, during manufacture of the ventilating cap 10, a groove generally indicated by the numeral 40 is cut along the midline of the connecting ply 28. As most clearly illustrated in FIG. 5, the bottom of the groove is defined by two sloping segments 42, each of which slope toward the layer 34 and meet along substantially the centerline of the ply 28. Referring to FIGS. 4 and 6, the groove 40 is formed by a cutting head 44 of multiple cutting blades which form a thickness equal to the desired width of the groove 40. The ply 28 is held against a die 46 having upwardly sloping surfaces 48 that meet at 50 to thereby form the sloping segments 42 of the groove 40. The ply 28 is held against the die by 46 by hold down devices 52 as the groove is cut by the cutting head 44.

Figure 2:
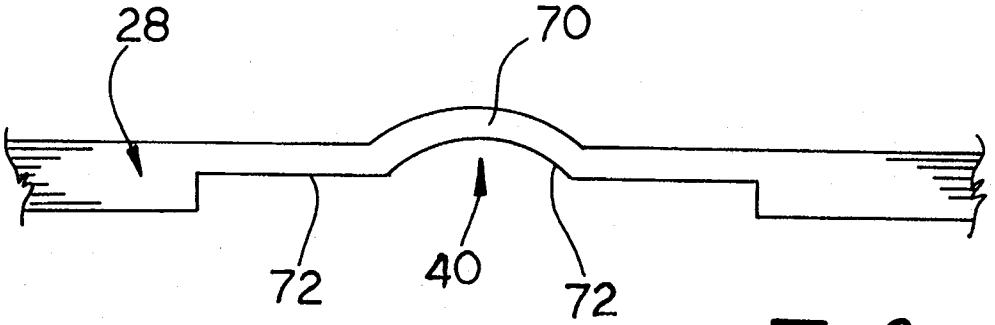
FIG. 2 is an end view of the upper ply of venting material used in the ventilating cap of FIG. 1 before the material has been bent to conform to the slope of the roof.
Figure 3:
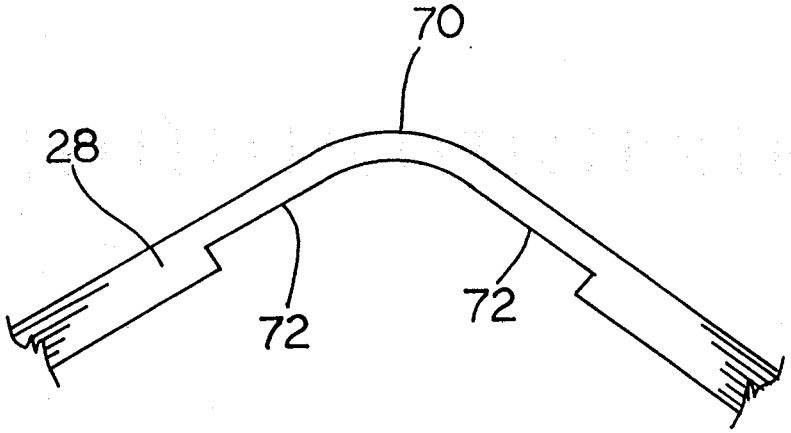
FIG. 3 is a view similar to FIG. 2 but illustrating the upper ply of the ventilating cap after it has been bent to assume the contour of the roof.

After the groove 40 is formed by the cutting head 44, the ventilating cap 10 is passed through a set of roll forming rollers 54, 56, which are mounted for rotation on corresponding axles 58, 60. The roller 56 includes a pair of substantially flat raised portions 62 which are separated by an arcuate surface 66. The roller 54 is defined by an outer arcuate surface 68 which is compatible with the surface 66 on roller 56. The ventilating cap 10 and the connecting ply 28 thereof is passed through the rollers 54, 56 such that the rollers roll along substantially the center line of the groove 40, such that the surfaces 66, 68 cooperate to define an arcuate surface 70 and the surfaces 62, 64 exert a bias on the ply 28 which flattens the edges of the groove 40 as at 72. Accordingly, as illustrated in FIGS. 2 and 3, a consistent crease can be formed which is defined by the arcuate surface 70, which is substantially stable along the entire length of the ventilating cap 10.

I claim:

1. A ventilating cap for the ridge of a roof, said roof having opposed upwardly tapering portions tapering upwardly toward said ridge, said roof having a longitudinal opening therein extending along said ridge, said ventilating cap comprising a pair of elongated vent parts extending along said upwardly tapering portions on opposite sides of said ridge, each of said vent parts including multiple plies of material defining passages communicating said opening with ambient atmosphere, each of said vent parts further including a bottom ply engaging said roof and an upper ply, said upper ply including a connecting portion extending across and along said ridge to interconnect said vent parts, and a groove in said connecting portion and extending along said ridge, said groove having a center portion extending longitudinally along the center of said groove and edge portions extending longitudinally along both of the edges of said groove, said upper ply being folded along said groove to extend over said ridge, said center portion being formed into an arcuate shape.

2. Ventilating cap as claimed in claim 1, wherein said upper ply includes a lower sheet engaging said vent parts, an upper sheet, and an intermediate layer between said sheets defining said passages, said groove extending through said lower sheet and into said intermediate layer.

3. Ventilating cap as claimed in claim 1, wherein said upper ply includes a lower sheet engaging said vent parts, an upper sheet, and an intermediate layer between said sheets defining said passages, said groove extending through said lower sheet and into said intermediate layer, said arcuate shape of said center portion extending longitudinally along substantially the center of the groove.

4. Method of manufacturing a ventilating cap for the ridge of a roof, said method including the steps of forming multiple plies of material, each ply defining passages, assembling said plies into two elongated stacks extending between a bottom ply to a top ply with a connecting portion of the top ply bridging between said stacks, forming a longitudinally extending groove in said connecting portion, and forming a portion of said groove into an arcuate surface.

5. Method of manufacturing a ventilating cap as claimed in claim 4, including the step of forming a pair of substantially flat surfaces along the edges of the groove, said arcuate surface extending between said flat surfaces.

6. Method of manufacturing a ventilating cap as claimed in claim 5, wherein said arcuate surface is formed by rolling a roll forming tool along said groove.

7. Method of manufacturing a ventilating cap as claimed in claim 5, wherein said groove is formed by a cutting head.

8. Method of manufacturing a ventilating cap as claimed in claim 5, wherein said method includes the step of folding said connecting portion along said arcuate surface.

9. Method of manufacturing a ventilating cap as claimed in claim 5, wherein the step of forming said top ply includes the steps of providing a pair of sheets, assembling said upper and lower sheets to an intermediate convoluted sheet to define said passages, and forming said groove by cutting through one of said sheets into said intermediate sheet to form said groove.

* * * * *

US005439417B1

REEXAMINATION CERTIFICATE (3910th)

United States Patent [19]

Sells

[11] B1 5,439,417

[45] Certificate Issued Oct. 26, 1999

[54] ROOF VENTILATING CAP

[75] Inventor: Gary L. Sells, Mishawaka, Ind.

[73] Assignee: Cor-A-Vent, Inc., Mishawaka, Ind.

Reexamination Request:
No. 90/004,163, Feb. 29, 1996

Reexamination Certificate for:

| | |
|---|---|
| Patent No.: | **5,439,417** |
| Issued: | **Aug. 8, 1995** |
| Appl. No.: | **08/333,438** |
| Filed: | **Nov. 2, 1994** |

[51] Int. Cl.[6] ..... F24F 7/02

[52] U.S. Cl. ..... 454/365; 16/225; 52/57; 264/285; 264/339

[58] Field of Search ..... 52/57, 194; 454/365; 72/174, 182, 379.2; 16/225; 264/334, 285, 295

[56] References Cited

U.S. PATENT DOCUMENTS

| | | | |
|---|---|---|---|
| 1,730,361 | 10/1929 | Fullenwider et al. | 72/182 |
| 3,197,536 | 7/1965 | French | 264/339 X |
| 4,299,643 | 11/1981 | Cross | 72/179 X |
| 4,803,813 | 2/1989 | Fiterman | 52/199 |
| 4,843,953 | 7/1989 | Sells . | |
| 4,876,950 | 10/1989 | Rudeen . | |
| 4,942,699 | 7/1990 | Spinelli | 52/57 |
| 5,054,254 | 10/1991 | Sells | 52/199 |
| 5,092,225 | 3/1992 | Sells | 454/365 |
| 5,094,041 | 3/1992 | Kasner et al. | 52/57 |
| 5,122,095 | 6/1992 | Wolfert | 454/365 |
| 5,304,095 | 4/1994 | Morris | 454/365 |
| 5,328,407 | 7/1994 | Sells | 454/365 |
| 5,331,783 | 7/1994 | Kasner et al. | 52/199 |

OTHER PUBLICATIONS

"Shingle Over Ridge Vent Trimline", Trimline Roof Ventilation Systems, Minneapolis, MN.

*Primary Examiner*—Harold Joyce

[57] ABSTRACT

The ventilating cap for the ridge of a roof includes multiple plies of ventilating material disposed on opposite sides of an opening cut along the ridge of the roof. The ventilating cap includes a connecting ply which interconnects a pair of vent parts disposed on opposite sides of the vent opening. The connecting ply is folded along a crease line, and includes a groove which extends longitudinally along the connecting ply at the crease line to permit a consistent fold of the connecting ply.

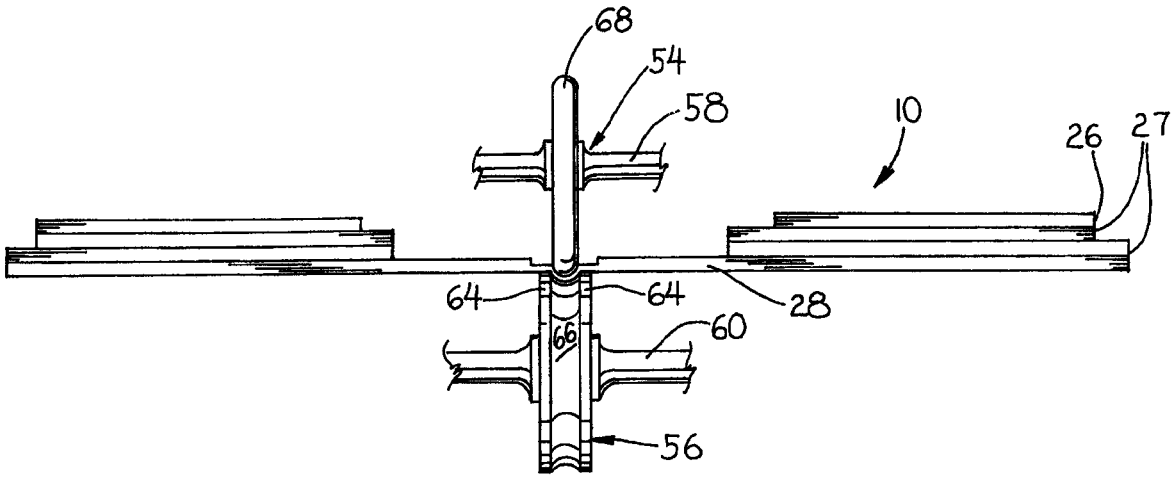

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4 and 5 are cancelled.

Claims 1 and 6-9 are determined to be patentable as amended.

Claims 2 and 3, dependent on an amended claim, are determined to be patentable.

New claim 10 is added and determined to be patentable.

1. A ventilating cap for the ridge of a roof, said roof having opposed upwardly tapering portions tapering upwardly toward said ridge, said roof having a longitudinal opening therein extending along said ridge, said ventilating cap comprising a pair of elongated vent parts extending along said upwardly tapering portions on opposite sides of said ridge, each of said vent parts including multiple plies of material defining passages communicating said opening with ambient atmosphere, each of said vent parts further including a bottom ply engaging said roof and an upper ply, said upper ply including a connecting portion extending across and along said ridge to interconnect said vent parts, and a groove in said connecting portion and extending

*longitudinally* along said ridge, said groove having a center portion extending longitudinally along the center of said groove, [and] edge portions extending longitudinally along both of the edges of said groove, *and uncurved portions extending between each of said edge portions and said center portion,* said upper ply being folded along said groove to extend over said ridge, said center portion being formed into an arcuate shape.

6. Method of manufacturing a ventilating cap as claimed in claim [5] *10*, wherein said arcuate surface is formed by rolling a roll forming tool along said groove.

7. Method of manufacturing a ventilating cap as claimed in claim [5] *10*, wherein said groove is formed by a cutting head.

8. Method of manufacturing a ventilating cap as claimed in claim [5] *10*, wherein said method includes the step of folding said connecting portion along said arcuate surface.

9. Method of manufacturing a ventilating cap as claimed in claim [5];0 *10*, wherein the step of forming said top ply includes the steps of providing a pair of sheets, assembling said upper and lower sheets to an intermediate convoluted sheet to define said passages, and forming said groove by cutting through one of said sheets into said intermediate sheet to form said groove.

*10. Method of manufacturing a ventilating cap for the ridge of a roof, said method including the steps of forming multiple plies of material each ply defining passages, assembling said plies into two elongated stacks extending between a bottom ply to a top ply with a connecting portion of the top ply bridging between said stacks, forming a longitudinally extending groove in said connecting portion, said groove having a pair of substantially flat surfaces along the edges of the groove and a pair of uncurved surfaces between said flat surfaces, and forming an arcuate surface in a portion of said groove extending between said uncurved surfaces.*

* * * * *